US006051086A

United States Patent [19]

Villamagna et al.

[11] Patent Number: 6,051,086

[45] Date of Patent: Apr. 18, 2000

[54] BUFFERED EMULSION BLASTING AGENT

[75] Inventors: Fortunato Villamagna; Anthony Francelj, both of Arlington; Scott Riley, McKinney; Curt Link, Arlington, all of Tex.

[73] Assignee: Orica Explosives Technology Pty Ltd., Melbourne, Australia

[21] Appl. No.: 09/093,948

[22] Filed: Jun. 8, 1998

[51] Int. Cl.[7] ..... C06B 45/00; C06B 31/28

[52] U.S. Cl. ..... 149/2; 149/46

[58] Field of Search ..... 149/46, 57, 19.9, 149/19.91, 2

[56] References Cited

U.S. PATENT DOCUMENTS

| | | | |
|---|---|---|---|
| 3,708,356 | 1/1973 | Mason et al. | 149/2 |
| 4,047,987 | 9/1977 | Kusakabe et al. | 149/37 |
| 4,820,361 | 4/1989 | McKenzie et al. | 149/2 |
| 4,822,433 | 4/1989 | Cooper et al. | 149/2 |
| 4,968,772 | 11/1990 | Whiteside | 528/230 |
| 4,968,773 | 11/1990 | Whiteside | 528/230 |
| 5,159,153 | 10/1992 | Cranney et al. | 102/313 |
| 5,322,576 | 6/1994 | Aitken et al. | 149/109.6 |
| 5,490,887 | 2/1996 | Cranney et al. | 149/2 |
| 5,538,530 | 7/1996 | Heaton et al. | 71/24 |
| 5,608,185 | 3/1997 | Granholm et al. | 149/108.4 |

OTHER PUBLICATIONS

D.R. Forshey et al., The Reactivity of Ammonium Nitrate–Fuel Oil with Pyrite–Bearing Ores, 1968, Bureau of Mines, RI 7187.

Y. Miron et al., The Reactivity of Aluminized AN–FO with Pyrite–Bearing Ores, 1976, Bureau of Mines, RI 8157.

Y. Miron et al., Reactivity of ANFO with Pyrite Containing Weathering Products—Evaluation of Additional Inhibitors, Bureau of Mines RI 8727.

T. Steis & W. Evans, Sulphide Ore/Explosives Exothermic Reactions, 1992 ICI Explosives Canada.

*Primary Examiner*—Charles T. Jordan
*Assistant Examiner*—Aileen J. Baker
*Attorney, Agent, or Firm*—Haynes & Boone, L.L.P.

[57] ABSTRACT

A buffered emulsion blasting agent is disclosed, particularly suited for use in connection with sulfide and pyrite ores. The buffered emulsion blasting agent comprises an emulsifier, an organic fuel in continuous phase, an oxidizer salt solution in discontinuous phase, and a buffering agent comprising a low molecular weight amine. The low molecular weight amine is preferably an alkylamine or alkanolamine having carbon chain lengths of from 2 to 5 and is more preferably diethanolamine. The buffering agent is present in the buffered emulsion blasting agent in a weight percent that is preferably within a range of from approximately 0.1% to 5%, more preferably within a range of from approximately 0.5% to 1%, and most preferably approximately 0.75%.

25 Claims, No Drawings

BUFFERED EMULSION BLASTING AGENT

BACKGROUND OF THE INVENTION

This invention relates to blasting agents, more particularly, to buffered emulsion blasting agents, and, more particularly, to buffered emulsion blasting agents for use in blasting in reactive ores.

Emulsion blasting agents are well known in the art and are often used in place of ammonium nitrate fuel oil (ANFO) blasting agents for safety reasons. The superior safety and stability of emulsion blasting agents can be particularly important when the blasting agents are to be used in hot and reactive mine conditions. For example, ammonium nitrate (AN) is prone to react with ores such as sulfide ores or pyrites that may be present in borehole walls of a mine, a reaction that is catalyzed by acid. The reaction is as follows:

$$AN+Fe^{II}\rightarrow -Fe^{III}+No_x+Heat$$

This reaction can be quite exothermic and can reach temperatures of greater than 842° F. (450° C.). The heat released from such a reaction is believed to be a common cause of problems such as premature detonations.

Buffering agents such as urea, sodium carbonate, calcium oxide, magnesium oxide, zinc oxide, phthalimide and xanthline have been added to ANFO to neutralize acids which would otherwise catalyze the decomposition reaction. These buffering agents have improved the stability of ANFO and increased the length of time before decomposition will occur. Still, even the buffered ANFO blasting agents do not offer the stability and protection from decomposition that is often desired in hot, reactive environments that are often experienced in mine boreholes, particularly in boreholes having sulfide or pyrite ores. One reason may be that the buffered ANFO blasting agent in effect has only a one-fold level of protection against the decomposition reaction, the removal or neutralization of a quantity of acid from the borehole wall. Once the buffering agent has been consumed in the acid/base neutralization reaction, the exothermic decomposition will continue to proceed at a faster rate as it will be increased by the low pH environment and increasing temperature. Also, the buffering agent in an ANFO is typically stagnant and will not move from the center of the borehole to the borehole wall to neutralize acidic ground water.

Emulsion blasting agents typically offer improved safety and stability in hot, acidic, reactive situations. This is likely because of a two-fold barrier against decomposition. First, to protect against this reaction, emulsion blasting agents have a protective barrier (surfactant/oil) layer encapsulating the AN solution, reducing direct contact between the AN and the reactive ore. The strength of this protective barrier, which corresponds to the stability and degree of water resistance, controls the rate to which the decomposition reaction will take place. Second, water is typically present in emulsion blasting agents in a weight percent of approximately 10% to 15% water, and the water acts as a heat sink for the decomposition reaction. Since the exothermic reaction is faster at higher temperatures, the heat sink effect would tend to slow the reaction. As a result, emulsion blasting agents tend to resist decomposition for periods extending from several hours to several days under conditions in which an ANFO blasting agent or a buffered ANFO blasting agent might resist decomposition for only a matter of a few minutes or hours. Compared to ANFO and buffered ANFO, these emulsion blasting agents typically offer improved stability and an increased length of time before decomposition will occur. Still, for more extreme conditions sometimes encountered in boreholes, particularly boreholes containing significant amounts of sulfide and pyrite ores, emulsion blasting agents do not offer the stability and protection from decomposition that is sometimes needed or desired.

To provide additional protection against decomposition, emulsion blasting agents have been provided packaged in a plastic film, with the plastic film providing a physical barrier to prevent acid from contacting the AN and therefore to provide protection from decomposition. The packaged emulsion blasting agents typically provide the stability and protection from decomposition desired, but they are not without problems. For example, handling problems tend to significantly increase the time required to load a borehole with the packaged emulsion blasting agent. This is particularly true in soft ground which must often be spooled out prior to loading of the packaged emulsion blasting agent. The predetermined sizes of the packages typically prevent the packaged emulsion blasting agent from providing a fully coupled system. Instead, there are typically voids around the product and the borehole walls. This decreases the performance of the product and often requires more drilling, loading and initiating products.

Efforts have been made to provide an emulsion blasting agent that is compatible with reactive sulfide/pyrite ores. Examples of such efforts are described in U.S. Pat. No. 5,159,153 (Cranney et al.) and in U.S. Pat. No. 5,608,185 (Granholm et al.), the entire contents of both of these patents being incorporated herein by reference. Cranney discusses the use of urea in an emulsion blasting agent for stabilization against thermal degradation with reactive sulfide/pyrite ores. Cranney proposes the addition of urea to an emulsion blasting agent as a dry powder, dry prill or preferably dissolved in the oxidizer phase to reduce the reactivity of the nitrate salts (particularly AN) in the emulsion blasting agent with sulfide/pyrite ores.

While the addition of urea to an emulsion blasting agent may provide improved protection against decomposition, it is not without problems. For example, urea is typically added to an emulsion blasting agent in prill form to minimize its destabilizing effect on the emulsion. The capacity for acid neutralization will depend on how much is added. The greater weight percent of urea prills present, the higher the acid neutralization capacity. Unfortunately, urea is a less effective explosive than AN, so as the amount of urea increases, so does the dilution of the explosive, eventually affecting explosive sensitivity and performance. Further, acid neutralization is diffusion controlled, meaning that the acid needs to migrate to the prill, and neutralization can take place only on the surface of the urea prill or in the prill volume. On a large scale, the urea may be homogeneously distributed, but this will likely not hold true on a small scale. In an actual loaded borehole, there may be significant differences in the distance between an acid producing region in a wall of a borehole and the nearest prill. As the distance an acid must travel to reach the nearest prill increases, the likelihood of decomposition increases. If the region over which the acid must pass is sufficiently large, containing a few grams of explosive, localized temperatures can quickly reach 200° to 500° F., causing large scale decomposition. If this region also happens to coincide with the location of a blasting cap or other initiating system, premature detonations can occur.

The addition of urea to the oxidizer solution in the discontinuous phase of the emulsion, as suggested in Cranney would make the urea concentration more uniform, even on a small scale, but the urea would essentially be contained within the emulsion droplet. The emulsion would effectively have to break down before the urea could be released. Adding urea to the oxidizer solution would also require careful control of the pH of the oxidizer.

SUMMARY OF THE INVENTION

It is therefore an object of the present invention to provide a buffered emulsion blasting agent and method of using the same which overcomes the problems associated with the above-discussed blasting agents.

It is a further object of the present invention to provide a buffered emulsion blasting agent and method of using the same that provides for a uniform distribution of the buffering agent on even a small scale.

It is a still further object of the present invention to provide a buffered emulsion blasting agent and method of using the same that provides improved stability and protection from decomposition in even extreme conditions encountered in mine boreholes.

It is a still further object of the present invention to provide a buffered emulsion blasting agent and method of using the same which is compatible with reactive sulfide and pyrite ores.

It is a still further object of the present invention to provide a buffered emulsion blasting agent and method of using the same which offers improved stability and protection from decomposition in hot, acidic, reactive environments.

It is a still further object of the present invention to provide a buffered emulsion blasting agent and method of using the same which uses a buffering agent which may be dispersed and dissolved in the emulsion.

It is a still further object of the present invention to provide a buffered emulsion blasting agent and method of using the same in which the buffering agent may be homogeneously mixed on a molecular level.

It is a still further object of the present invention to provide a buffered emulsion blasting agent and method of using the same in which the buffering agent may occupy a role both in the continuous and discontinuous phases.

It is a still further object of the present invention to provide a buffered emulsion blasting agent and method of using the same in which the buffering agent has an appropriate intermediate pKa value.

It is a still further object of the present invention to provide a buffered emulsion blasting agent and method of using the same in which the buffering agent is alkaline.

It is a still further object of the present invention to provide a buffered emulsion blasting agent and method of using the same in which the buffering agent is compatible with the emulsion.

It is a still further object of the present invention to provide a buffered emulsion blasting agent and method of using the same which offers the stability and protection from decomposition of a packaged emulsion blasting agent without the accompanying handling problems.

It is a still further object of the present invention to provide a buffered emulsion blasting agent and method of using the same which uses a low molecular weight amine as a buffering agent.

It is a still further object of the present invention to provide a buffered emulsion blasting agent and method of using the same which uses an alkylamine or alkanolamine as a buffering agent.

It is a still further object of the present invention to provide a buffered emulsion blasting agent and method of using the same which uses diethanolamine as a buffering agent.

Toward the fulfillment of these and other objects and advantages, the buffered emulsion blasting agent of the present invention comprises an emulsifier, an organic fuel in continuous phase, an oxidizer salt solution in discontinuous phase, and a buffering agent comprising a low molecular weight amine. The low molecular weight amine is preferably an alkylamine or alkanolamine having carbon chain lengths of from 2 to 5 and is more preferably diethanolamine. The buffering agent is present in the buffered emulsion blasting agent in a weight percent that is preferably within a range of from approximately 0.1% to 5%, more preferably within a range of from approximately 0.5% to 1%, and most preferably approximately 0.75%.

DETAILED DESCRIPTION OF THE PREFERRED EMBODIMENT

The buffered emulsion blasting agent of the present invention comprises an emulsifier, an organic fuel in a continuous phase, an oxidizer salt solution in a discontinuous phase, and a buffering agent comprising a low molecular weight amine.

The emulsifier aids in the formation of the emulsion and improves the stability thereof. The emulsifier component may be chosen from a wide range of emulsifying agents known in the art to be suitable for the preparation of emulsion blasting agents. Examples of such emulsifying agents include alcohol alkoxylates, phenol alkoxylates, poly (oxyalkylene) glycols, ploy(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene) glycol esters, fatty acid amides, fatty acid amide alkoxylates, fatty amine, quaternary amines, alkyloxazolines, alkenyloxazolines, imidazolines, alkyl-sulfonates, alkylarylsufonates, alkylsulfosuccinates, alkylphosphates, alkenylphosphates, phosphate esters, lecithin, copolymers of poly(oxyalkylene) glycols and poly (12-hydroxystearic acid), condensation products of compounds comprising at least one primary amine and poly[alk(en)yl]succinic acid or anhydride, and mixtures thereof.

Among the preferred emulsifying agents are the 2-alkyl and 2-alkenyl-4,4'bis(hydroxymethyl)oxazolines, the fatty acid esters of sorbitol, lecithin, copolymers of poly (oxyalkylene) glycols and poly(12-hydroxystearic acid), condensation products of compounds comprising at least one primary amine and poly[alk(en)yl]succinic acid or anhydride, and mixtures thereof More preferably, the emulsifier component comprises a condensation product of a compound comprising at least one primary or secondary amine and a poly[alk(en)yl]succinic acid or anhydride. A preferred emulsifier is a polyisobutylene succinic anhydride (PIBSA) based surfactant, which surfactants are described in Canadian Patent No. 1,244,463 (Baker). Australian Patent Application No. 40006/85 (Cooper et al.) discloses emulsion blasting agents in which the emulsifier is a condensation product of a poly[alk(en)yl]succinic anhydride and an amine such as ethylene diamine, diethlyene triamine and ethanolamine. Further examples of preferred condensation products may be found in Australian Patent Application Nos. 29933/89 and 29932/89.

Typically the emulsifier component of the emulsion blasting agent comprises up to 5% by weight of the emulsion blasting agent. Higher proportions of the emulsifier component may be used and may serve as a supplemental fuel for the composition, but in general, it is not necessary to add more than 5% by weight to achieve the desired effect. Stable emulsions can be formed using relatively low levels of emulsifier component. The level of emulsifier component is preferably in the range of from approximately 0.4% to approximately 3.0% by weight of the emulsion blasting agent and is more preferably approximately 2.63% by weight of the emulsion blasting agent.

The organic fuel in continuous phase of the emulsion blasting agent comprises a vegetable oil, such as the organic fuel in continuous phase described in U.S. Pat. No. 5,322,576 (Aitken et al.), the entire content of which is incorporated herein by reference. However, the vegetable oil may be mixed with a variety of other organic fuels which are typically used in the manufacture of emulsion blasting agents. Suitable organic fuels for use in the continuous phase include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes, (e.g. microcrystalline wax, paraffin wax, and slack wax), paraffin oils, benzene, toluene, xylenes, asphaltic materials, polymeric oils such as the low molecular weight polymers of olefins, animal oils, fish oils and other mineral, hydrocarbon or fatty oils, and mixtures thereof. Preferred organic fuels are liquid hydrocarbons, generally referred to as petroleum distillate, such as gasoline, kerosene, fuel oils and paraffin oils. More preferably the organic fuel is paraffin oil.

The organic fuel in continuous phase component of the emulsion blasting agent comprises preferably approximately 3% to approximately 30% by weight of the emulsion blasting agent, more preferably approximately 5% to approximately 15% by weight of the emulsion blasting agent, and most preferably approximately 4.18% by weight of the emulsion blasting agent.

The oxidizer salt solution in discontinuous phase of the emulsion blasting agent is preferably selected from the group consisting of alkali and alkaline earth metal nitrates, chlorates and perchlorates, ammonium nitrate, ammonium chlorates, ammonium perchlorate and mixtures thereof. It is particularly preferred that the oxidizer salt is ammonium nitrate, or a mixture of ammonium and sodium nitrate. A preferred oxidizer salt solution comprises approximately 69% AN, 15% sodium nitrate and 16% water, by weight.

The oxidizer salt is typically a concentrated aqueous solution of the salt or mixture of salts. However, the oxidizer salt may also be a liquefied, melted solution of the oxidizer salt where a lower water content is desired. The oxidizer salt-containing discontinuous phase of the emulsion blasting agent may also be a eutectic composition. By eutectic composition it is meant that the melting point of the composition is either at the eutectic or in the region of the eutectic of the components of the composition.

The oxidizer salt for use in the discontinuous phase of the emulsion blasting agent may further comprise a melting point depressant. Suitable melting point depressants for use with AN in the discontinuous phase include inorganic salts such as lithium nitrate, silver nitrate, lead nitrate, sodium nitrate, potassium nitrate, alcohols, such as methyl alcohol, ethylene glycol, glycerol, mannitol, sorbitol, pentacrythritol, carbohydrates such as sugars, starches and dextrins, aliphatic carboxylic acids and their salts such as formic acid, acetic acid, ammonium formate, sodium formate, sodium acetate, and ammonium acetate, glycine, chloraceptic acid, glycolic acid, succinic acid, tartaic acid, adipic acid, lower aliphatic amides such as formamide, acetamide and urea, urea nitrate, nitrogenous substances such as nitroguanidine, guanidine nitrate, methylamine, methylamine nitrate, and ethylene diamine dinitrate; and mixtures thereof.

Typically, the discontinuous phase of the emulsion blasting agent comprises approximately 60% to approximately 97% by weight of the emulsion blasting agent, preferably approximately 85% to approximately 95% by weight of the emulsion blasting agent and more preferably approximately 90.6% by weight of the emulsion blasting agent.

The emulsion blasting agent may additionally comprise a discontinuous gaseous component which gaseous component can be utilized to vary the density and sensitivity of the explosive composition. The methods of incorporating a gaseous component and the enhanced sensitivity of explosive compositions comprising gaseous components are well known to those skilled in the art. The gaseous components may, for example, be incorporated into the emulsion blasting agent as fine gas bubbles dispersed through the composition, as hollow particles which are often referred to as microballoons or as microspheres, as porous particles, or mixtures thereof.

A discontinuous phase of fine gas bubbles may be incorporated into the emulsion blasting agent by mechanical agitation, injection or bubbling the gas through the composition, or by chemical generation of the gas in situ. Suitable chemicals for the in situ generation of gas bubbles include peroxides, such as hydrogen peroxide, nitrates, such as sodium nitrate, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which react under conditions of acid pH to produce gas bubbles. Preferred nitrous acid salts include alkali metal nitrites, such as sodium nitrite. Catalytic agents such as thiocyanate or thiourea may be used to accelerate the reaction of a nitrite gassing agent. Suitable small hollow particles include small hollow microspheres of glass or resinous materials, such as phenol-formaldehyde, urea-formaldehyde and copolymers of vinylidene chloride and acrylonitrile. Suitable porous materials include expanded minerals such as perlite, and expanded polymers such as polystyrene.

Typically, the gaseous component in discontinuous phase is preferably formed by glass microballoons which are preferably present in the emulsion blasting agent in a weight percent of approximately 2.6%.

The buffering agent is preferably a low molecular weight amine, is more preferably a low molecular weight alkylamine or low molecular weight alkanolamine, having carbon chain lengths of from 2 to 5, and is most preferably diethanolamine. The buffering agent preferably has an intermediate alkalinity to avoid a destabilizing effect of the emulsion blasting agent. For example, for alkylamines or alkanolamines having carbon chain lengths of greater than or equal to 6, the amine will begin to have a destabilizing effect on the emulsion blasting agent. Similarly, a $C_1$ amine would tend to be more alkaline and would tend to destabilize the emulsion blasting agent. Accordingly, a buffering agent is selected with a desired pKa value representing an intermediate alkalinity.

Diethanolamine is the most preferred buffering agent for a number of reasons. For example, it is compatible with the emulsion blasting agent. In fact, as described in U.S. Pat.

No. 4,822,433 (Cooper et al.), the entire contents of which are incorporated herein by reference, diethanolamine may be used in preparing a surfactant which may be present in the emulsifier component of the emulsion blasting agent. Further, it may be added to the organic fuel in discontinuous phase or to the emulsion blasting agent after it is prepared. Further still, diethanolamine is soluble in water and in polar organic materials, making it suitable for use in connection with a wide range of materials. Also, relatively small concentrations of diethanolamine offer superior stability and protection from decomposition.

The buffering agent is present in the buffered emulsion blasting agent in a weight percent within a range which is preferably between approximately 0.1% to approximately 5%, is more preferably within a range of approximately 0.5% to 1%, and is most preferably approximately 0.75%.

Contrary to the teachings of Cranney and Granholm, the buffering agent of the present invention is not added to the oxidizer salt solution in discontinuous phase but is, instead added to the organic fuel, or is preferably added to the emulsion blasting agent after the continuous and discontinuous phases have been combined. The buffering agent is an alkaline or base, and the oxidizer salt solution is an acid. If the buffering agent were added directly to the oxidizer salt solution, the buffering agent would have a tendency to attack the AN in the oxidizer salt solution. Adding the buffering agent only after the continuous and discontinuous phases have been combined, greatly reduces the reactions between the buffering agent and the AN in the oxidizer salt solution.

Once added, some of the buffering agent will be dissolved in the organic fuel in continuous phase, some will be dispersed in the organic fuel in continuous phase, and some will make its way into the droplets of the oxidizer salt solution in discontinuous phase. The buffering agent creates a buffering capacity in the emulsion to neutralize acids, ground water, thereby providing extra time before a decomposition will occur. Unlike buffered ANFO or emulsions that are mixed with a prilled buffering agent, thereby forming a stagnant heterogeneous mixture, the present buffered emulsion blasting agent is a homogeneous mixture. The diffusion time of an acid into this emulsion matrix is substantially reduced because the buffering agent is mobile within the emulsion matrix. This means that acid at a borehole wall will have to overcome all of the buffering agent within the matrix as a concentration gradient will form. The buffering agent is able to move from the center of the borehole to the borehole wall which may be exposed to an acidic environment, such as a sulfuric acid environment.

The buffering agent may be added to the emulsion blasting agent at any time after the continuous and discontinuous phases have been combined. It may be added before or after the addition of microballoons or other gaseous components, may be added before packaging or at the location where it will be used.

The compositions of the present invention can be delivered in bulk form to a borehole, using methods well known in the art, or can be used in packaged form. Borehole liners can also be used to provide extra protection.

Laboratory samples were prepared, tested and monitored to compare the performance of various blasting agents under similar conditions. The samples tested included Buffered HANDIBULK, a buffered emulsion blasting agent of the present invention having a buffering agent in a weight percent of approximately 0.75%; MAGNUM, a packaged emulsion blasting agent; APEX 1000 and APEX 1010, two standard emulsion blasting agents having different rheologies; a buffered ANFO; and ANFO. In Examples 1–3, the buffering agent in the Buffered HANDIBULK was diethanolamine; in Examples 4–6, different, identified buffering agents were used; and in Examples 7–9, the estimated lab and field results for the Buffered HANDIBULK assume the use of diethanolamine as the buffering agent. The samples were prepared and monitored over time to determine when an ammonium nitrate decomposition reaction occurred. Tests were performed on both reagent ferrous suphate (FeS—pure chemical form) and on samples of reactive sulfide ores. The samples were all prepared in a similar fashion to obtain comparative results. For each sample, the oven was heated to the desired temperature. A 10% nitric acid solution was prepared, and the FeS was mixed with the nitric acid solution in a fume hood. The pH of this mixture was checked to ensure that it had been acidified (pH<1.0). The appropriate amount of each product was weighed and added to this mixture in the fume hood, and initial temperatures were recorded with thermometers. The samples were then placed in the oven and observed. The temperatures and other observations such as discoloration or crystallization were recorded, and the samples were monitored for decomposition reactions.

EXAMPLE 1

At 240° F., the samples were monitored for seven hours. The Buffered HANDIBULK prepared according to the present invention and the MAGNUM packaged emulsion product had not decomposed at the end of the test. APEX 1000, the higher rheology, standard emulsion product decomposed at approximately 6 hours, and APEX 1010, the lower rheology, standard emulsion product decomposed at approximately 3 hours. The Buffered ANFO decomposed in approximately 30 minutes, and the ANFO product decomposed in approximately 20 minutes.

EXAMPLE 2

At 290° F., the samples were monitored for six hours. The Buffered HANDIBULK prepared according to the present invention and the MAGNUM packaged emulsion product had not decomposed at the end of the test. APEX 1000, the higher rheology, standard emulsion product decomposed at approximately 4 hours, and APEX 1010, the lower rheology, standard emulsion product decomposed at approximately 2 hours. The Buffered ANFO decomposed in approximately 15 minutes, and the ANFO product decomposed in approximately 5 minutes.

EXAMPLE 3

The samples were prepared using monoethanolamine as a buffering agent in each sample except the ANFO product. At 230° F., the samples were monitored for eight hours. The Buffered HANDIBULK and the MAGNUM packaged emulsion had not decomposed at the end of the test. APEX 1000, the higher rheoloy, standard emulsion product decomposed at approximately 5 hours. APEX 1010, the lower rheology, standard emulsion product decomposed at approximately 3 hours. The Buffered ANFO decomposed in approximately 35 minutes, and the ANFO product decomposed in approximately 25 minutes.

EXAMPLE 4

The samples were prepared using diethyl ethanolamine as a buffering agent in each sample except the ANFO product. At 230° F., the samples were monitored for eight hours. The Buffered HANDIBULK and the MAGNUM packaged emulsion had not decomposed at the end of the test. APEX 1000, the higher rheology standard emulsion product decomposed at approximately 5 hours, and APEX 1010, the lower rheology, standard emulsion product decomposed at approximately 3 hours. The Buffered ANFO decomposed in approximately 35 minutes, and the ANFO product decomposed in approximately 25 minutes.

EXAMPLE 5

The samples were prepared using ethyl amine as a buffering agent in each sample except the ANFO product. The samples were tested at 100° F. due to the lower boiling point of the amine used. The samples were monitored for 45 hours. The Buffered HANDIBULK and the MAGNUM packaged emulsion product had not decomposed at the end of the test. APEX 1000, the higher rheology, standard emulsion product decomposed at approximately 17 hours, and APEX 1010, the lower rheology, standard emulsion product decomposed at approximately 12 hours. The Buffered ANFO decomposed at approximately 5 hours, and the ANFO product decomposed at approximately 5 hours.

EXAMPLE 6

The samples were prepared using diethyl amine as the buffering agent in each sample except the ANFO product. This sample was tested at 125° due to the low boiling point of the amine used. The samples were monitored for 45 hours. The Buffered HANDIBULK and the MAGNUM packaged emulsion had not decomposed at the end of the test. APEX 1000, the higher rheology, standard emulsion product decomposed at approximately 17 hours, and APEX 1010, the lower rheology, standard emulsion product decomposed at approximately 12 hours. Th Buffered ANFO decomposed in approximately 5 hours, and the ANFO product decomposed in approximately 5 hours.

EXAMPLE 7

The values in Examples 7–9 are estimated from lab and field results. In a reactive ore environment, at a temperature of 150° F., it is estimated that the Buffered HANDIBULK prepared according to the present invention and the MAGNUM packaged emulsion product would remain stable for approximately 48 hours. It is estimated that APEX 1000, the higher rheology, standard emulsion product would remain stable for approximately 35 hours, and APEX 1010, the lower rheology, standard emulsion product would remain stable for 25 hours. It is estimated that the Buffered ANFO would remain stable for approximately 5 hours, and the ANFO product would remain stable for approximately 3 hours.

EXAMPLE 8

In a reactive ore environment, at a temperature of 200° F., it is estimated that the Buffered HANDIBULK prepared according to the present invention and the MAGNUM packaged emulsion product would remain stable for approximately 35 hours. It is estimated that APEX 1000, the higher rheology, standard emulsion product would remain stable for approximately 10 hours, and APEX 1010, the lower rheology, standard emulsion product would remain stable for 5 hours. It is estimated that the Buffered ANFO would remain stable for approximately 2 hours, and the ANFO product would remain stable for approximately 1 hour.

EXAMPLE 9

In a reactive ore environment, at a temperature of 290° F., it is estimated that the Buffered HANDIBULK prepared according to the present invention and the MAGNUM packaged emulsion product would remain stable for approximately 25 hours. It is estimated that APEX 1000, the higher rheology, standard emulsion product would remain stable for approximately 4 hours, and APEX 1010, the lower rheology, standard emulsion product would remain stable for 2 hours. It is estimated that the Buffered ANFO would remain stable for approximately 45 minutes, and the ANFO product would remain stable for approximately 15 minutes.

Of course, the measured and estimated times to decomposition in these examples may vary under actual borehole blasting conditions and should be used only as guidelines for comparison purposes and to show general trends.

As illustrated by the above examples, the buffered emulsion blasting agent of the present invention offers superior stability and protection from decomposition, even in hot, reactive conditions and even in the presence of reactive sulfide and pyrite ores. It offers the stability and protection of a packaged emulsion blasting agent and the ease of handling of standard bulk emulsion blasting agents.

Other modifications, changes and substitutions are intended in the foregoing, and in some instances, some features of the invention will be employed without a corresponding use of other features. While the present invention has been described with reference to certain illustrative examples and preferred embodiments, various modifications will be apparent to those skilled in the art and any such modifications are intended to be within the scope of the invention as set forth in the appended claims. Accordingly, it is appropriate that the appended claims be construed broadly and in a manner consistent with the scope of the invention.

What is claimed is:

1. A method of preparing a buffered emulsion blasting agent, comprising:

(a) combining an emulsifier, an organic fuel in continuous phase, and an oxidizer salt solution in discontinuous phase to form an emulsion blasting agent; and (b) adding a buffering agent to said emulsion blasting agent to form a buffered emulsion blasting agent, said buffering agent comprising a low molecular weight amine present in a weight percent between 0.1% and 5%.

2. The method of claim 1, wherein said low molecular weight amine is selected from the group consisting of alkylamines and alkanolamines.

3. The method of claim 1, wherein said low molecular weight amine is selected from the group consisting of alkylamines having carbon chain lengths of from 2 to 5 and alkanolamines having carbon chain lengths of from 2 to 5.

4. The method of claim 1, wherein said buffering agent is diethanolamine.

5. The method of claim 1 wherein step (b) comprises adding diethanolamine to said emulsion blasting agent so that said diethanolamine is present in said buffered emulsion blasting agent in a weight percent of from approximately 0.5% to approximately 1%.

6. The method of claim 1 wherein step (b) comprises adding diethanolamine to said emulsion blasting agent so that said diethanolamine is present in said buffered emulsion blasting agent in a weight percent of approximately 0.75%.

7. A buffered emulsion blasting agent, comprising:

an emulsifier;

an organic fuel in continuous phase;

an oxidizer salt solution in discontinuous phase; and a buffering agent comprising a low molecular weight amine present in a weight percent between 0.1% and 5%.

8. The buffered emulsion blasting agent of claim 7, wherein said low molecular weight amine is selected from the group consisting of alkylamines and alkanolamines.

9. The buffered emulsion blasting agent of claim 7, wherein said low molecular weight amine is selected from the group consisting of alkylamines having carbon chain lengths of from 2 to 5 and alkanolamines having carbon chain lengths of from 2 to 5.

10. The buffered emulsion blasting agent of claim 7, wherein said buffering agent is diethanolamine.

11. The buffered emulsion blasting agent of claim 10, wherein said diethanolamine is present in said buffered emulsion blasting agent in a weight percent of from approximately 0.5% to approximately 1%.

12. The buffered emulsion blasting agent of claim 10, wherein said diethanolamine is present in said buffered emulsion blasting agent in a weight percent of approximately 0.75%.

13. A method of blasting in reactive ores containing sulfides and/or pyrites, comprising the use of a buffered emulsion blasting agent comprising:

an emulsifier;

an organic fuel in continuous phase;

an oxidizer salt solution in discontinuous phase; and a buffering agent, said buffering agent comprising a low molecular weight amine present in a weight percent between 0.1% and 5%.

14. The method of claim 13, wherein said low molecular weight amine is selected from the group consisting of alkylamines and alkanolamines.

15. The method of claim 13, wherein said low molecular weight amine is selected from the group consisting of alkylamines having carbon chain lengths of from 2 to 5 and alkanolamines having carbon chain lengths of from 2 to 5.

16. The method of claim 13, wherein said buffering agent is diethanolamine.

17. The method of claim 16 wherein said diethanolamine is present in said buffered emulsion blasting agent in a weight percent of from approximately 0.5% to approximately 1%.

18. A process of preparing a buffered emulsion blasting agent, comprising:

(a) combining an emulsifier comprising a succinic anhydride condensed with an amine, an organic fuel in continuous phase, and an oxidizer salt solution in discontinuous phase to form an emulsion blasting agent; and (b) thereafter adding a buffering agent to the emulsion blasting agent to form a buffered emulsion blasting agent, the buffering agent comprising a low molecular weight amine.

19. The process of claim 18 wherein the buffering agent is diethanolamine, and is present in the emulsion blasting agent in a weight percent of from approximately 0.5% to 1%.

20. A buffered emulsion blasting agent, comprising:

an emulsifier;

an organic fuel in continuous phase;

an oxidizer salt solution in discontinuous phase; and a buffering agent.

21. The blasting agent of claim 20 wherein the buffering agent is diethanolamine, and is present in the emulsion blasting agent in a weight percent of from approximately 0.5% to 1%.

22. A process of preparing a buffered emulsion blasting agent, comprising:

providing an organic fuel in continuous phase;

providing an oxidizer salt solution in discontinuous phase;

combining the organic fuel and oxidizer salt solution with an emulsifier to form an emulsion; and thereafter adding a buffer to the emulsion.

23. The process of claim 22 wherein the buffer is soluble both in water and in polar organic materials.

24. The process of claim 22 wherein the buffer has a pKa value representing an intermediate alkalinity.

25. The process of claim 22 wherein the buffer is diethanolamine, and is present in the emulsion blasting agent in a weight percent of from approximately 0.5% to 1%.

* * * * *